United States Patent [19]

James

[11] 3,966,248

[45] June 29, 1976

[54] SAFETY DOOR LOCK

[76] Inventor: Loyal W. James, P.O. Box 129, Chickasha, Okla. 73018

[22] Filed: June 29, 1972

[21] Appl. No.: 267,644

[52] U.S. Cl. ..... 292/340; 292/341.18; 292/DIG. 65

[51] Int. Cl.[2] ..... E05C 15/02

[58] Field of Search ..... 292/340, 341.18, 21, 292/92, 93, DIG. 65

[56] References Cited

UNITED STATES PATENTS

| | | | |
|---|---|---|---|
| 2,472,174 | 6/1949 | Schneider | 292/340 |
| 2,533,396 | 12/1950 | Payne | 292/340 |
| 2,581,606 | 1/1952 | Seaman | 292/74 |
| 2,618,498 | 11/1952 | Schlesser | 292/340 |
| 2,695,807 | 11/1954 | Bisset | 292/341.18 |

*Primary Examiner*—Robert L. Wolfe
*Attorney, Agent, or Firm*—Laney, Dougherty, Hessin & Fish

[57] ABSTRACT

A break-away door lock assembly for use in minimum security areas. The assembly consists of a door lock keeper assembly which includes adjustable pressure pads bearing upon and maintaining a door lock keeper plate in proper coactive position. Thus, the pressure structure can be pre-set to enable opening of the locked door by application of some extraordinary pulling force when occasion might arise that there is no key, or that the door is locked from the inside or the like, and it is necessary to open the door immediately.

6 Claims, 11 Drawing Figures

SAFETY DOOR LOCK

BACKGROUND OF THE INVENTION

1. Field of the Invention

The invention relates generally to door locking assemblies and, more particularly, but not by way of limitation, it relates to improvements in household door lock assemblies which enable an adjustable lock-break function.

2. Description of the Prior Art

The prior art includes very few teachings which are directed to locking assemblies specifically embodying a lock-break capability. This probably results from the fact that such function is anti-thetical in and of itself, but nevertheless such capability can be extremely valuable as evidenced by the numerous problems encountered relative to locking intra-household doors and the propensity for curious, small children to manipulate such devices. The closest prior art known at this time appears to be U.S. Pat. No. 2,472,174 which teaches a form of break-away lock assembly that embodies a lock destruction function; however, the present invention offers much advantage and improvements in design considerations relative to the early teachings.

SUMMARY OF THE INVENTION

The present invention contemplates a safety door lock assembly wherein a lock keeper plate is adjustably pressure retained within a door jamb inset assembly for engagement with an adjoining door lock bolt. In a more limited aspect, the invention embodies specific forms of pressure exerting member and adjustment structure utilized in conjunction with the door jamb inset assembly, which pressure exerting assembly is operable to enable adjustment as to the necessary lock break-away force to be applied.

Therefore, it is an object of the present invention to provide a safety lock device which is economical in construction and manufacture while offering distinctly advantageous functional usage.

It is also an object of the invention to provide a break-away lock assembly that is especially desirable for use in certain intra-household door closure applications.

It is yet another object of the invention to provide a safety lock device which is readily adjustable by members of the household to set the break-away threshold force as desired.

Finally, it is an object of the present invention to provide a break-away lock device for intra-household use which requires no key or insertion manipulation device to open the lock during times of emergency.

Other objects and advantages of the invention will be evident from the following detailed description when read in conjunction with the accompanying drawings which illustrate the invention.

DETAILED DESCRIPTION OF THE PREFERRED EMBODIMENT

Figure 1:
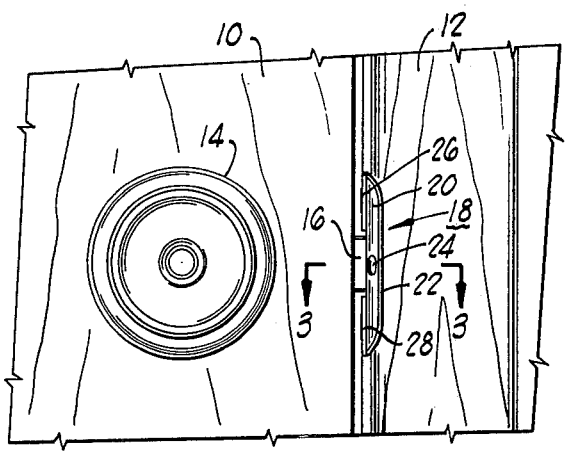
FIG. 1 is an elevational plan view of a door lock assembly in its closed position.

Reference to FIG. 1 illustrates the well-known assembly of a door 10 as closed and in combination with the door jamb structure 12. The door 10 includes a usual form of door lock actuating assembly, many well-known forms being available, which utilize a doorknob 14 to actuate a lock bolt 16 into and out of engagement with a lock keeper assembly 18. Visible externally of the keeper assembly 18 are a keeper plate 20 including a flared or bent striker portion 22 having a striker button 24, and respective upper and lower pressure plates 26 and 28.

Figure 2:
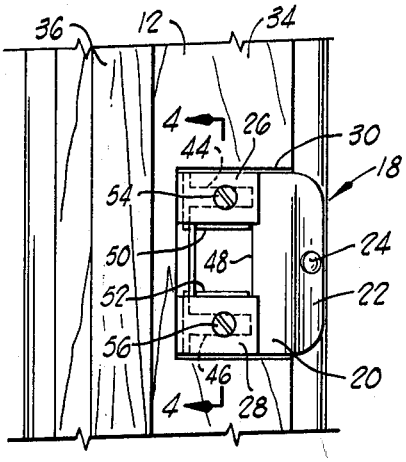
FIG. 2 is an elevational plan view of a door keeper assembly as constructed in accordance with the present invention.
Figure 3:
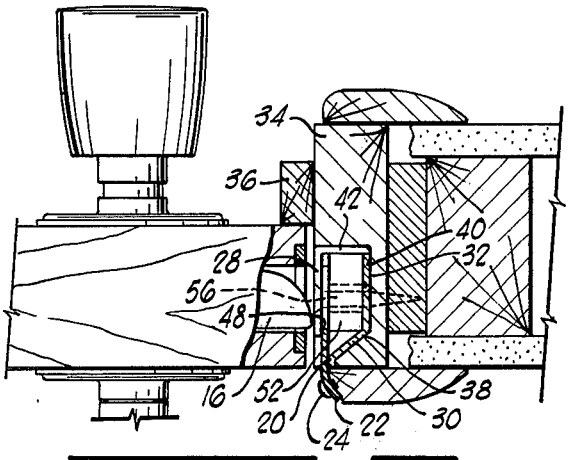
FIG. 3 is a section taken along line 3—3 of FIG. 1.
Figure 4:
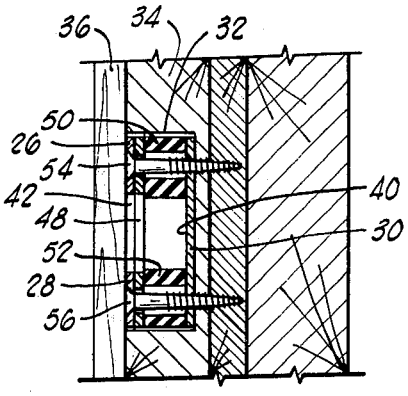
FIG. 4 is a section taken along lines 4—4 of FIG. 2.

Referring now to FIGS. 2, 3 and 4, the lock striker assembly 18 is mounted or retained in an inset element 30 which is secured in a fitted recess 32 formed within a door jamb 34. The recess 32 is so formed as to allow positioning of the inset element 30 and, therefore, lock keeper assembly 18 at the edge or door opening side of door jamb 34. In accordance with usual construction, a suitable form of limit strip 36 is secured along door jamb 34 to provide door closure limit.

The inset structure 30 may be a bended formation to include such as (see FIG. 3) a forward portion 38, inset or bottom 40, rear wall 42 and top portion forming pressure plates 26 and 28. It will be noted that the forward portion 38 is inclined upwardly from the bottom 40 and away from the rear wall 42 providing a ramp surface slidingly engageable with the outer end of the bolt 16 as will be described more fully hereinafter. Alternatively, it has been found that pressure plates 26 and 28 may be formed as separate plates in order to enable more uniform pressure application, we will be further described below. Also, end plates, i.e. top and bottom walls, may be formed integrally with the bended formation of inset 30, if so desired. However, such design choice would constitute no particular inventive advantage and is mainly a manufacturing cost consideration.

Returning to striker plate 20, and referring specifically to FIG. 2, striker plate 20 is formed to include a pair of similarly formed longitudinal slots 44 and 46 and to define a generally square or rectangular lock aperture 48 for receiving door lock bolt 16 therethrough when in the locked or closed position. A pair of pressure pads 50 and 52 are then disposed beneath the slotted end portions of striker plate 20. Pressure pads 50 and 52 each may be formed from suitable resilient material such as rubber or plastic, it only being necessary to select a material having the physical substance to exert the desired amount of frictional grip under pressure. A pair of screw fasteners 54 and 56 are then secured through suitable apertures in pressure plates 26 and 28, keeper plate slots 44 and 46, and respective pressure pads 50 and 52 for threaded insertion into door jamb structure 12.

In operation, the household user secures each of screws 54 and 56 to whatever desired tightness that will cause pressure plates 26 and 28 to seize slotted edges of striker plate 20 as it bears against respective pressure pads 50 and 52 and bottom portion 40 of inset element 30. The striker plate 20 can be seized to yield at any desired threshold door pulling force by the setting of screw fasteners 54 and 56. Upon the yielding of the striker plate 20 under the desired door pulling force, the striker plate 20 moves out of engagement between the pressure plates 26 and 28 and the pads 50 and 52 in a downward direction as viewed in FIG. 3. The bolt 16 also swings downwardly with the door, as viewed in FIG. 3, and the outer end of the bolt 16 engages the forward portion 38 of the inset structure 30. Continued movement of the door in the downward direction causes the bolt 16 to be cammed inwardly (to the left in FIG. 3) by the forward portion 38 an amount sufficient to clear the door jamb 34 without causing damage thereto. The structure as shown in FIGS. 1–4 may be utilized to enable some multiple of emergency door-openings, but it may also be expected that eventually the thread moorings within wooden door jamb assembly 12 will become less positive. Therefore, it is also proposed to use a double screw fastener assembly, as will be further described below in conjunction with FIG. 11.

Figure 5:
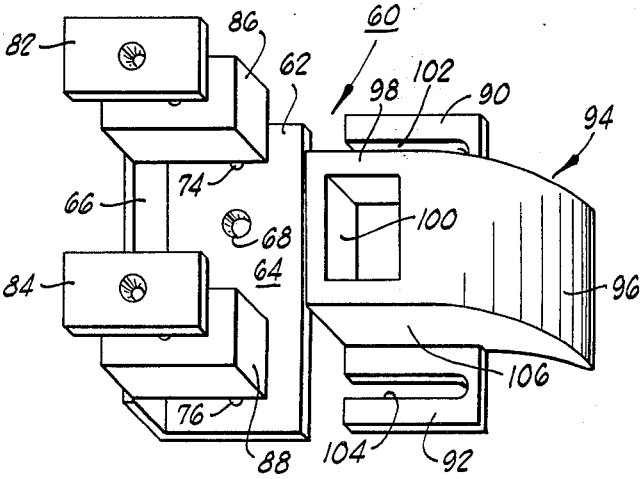
FIG. 5 is an exploded view shown in perspective of an alternative form of break-away door lock device.
Figure 6:
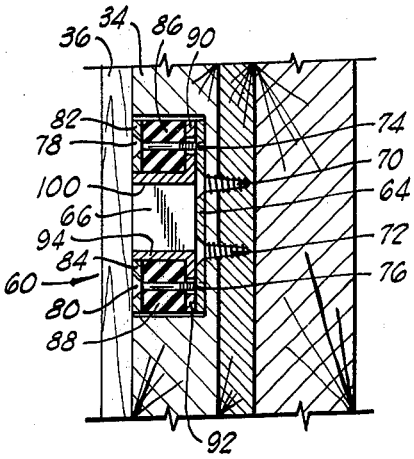
FIG. 6 is a vertical section through an assembled and installed door lock device as shown in FIG. 5.
Figure 7:
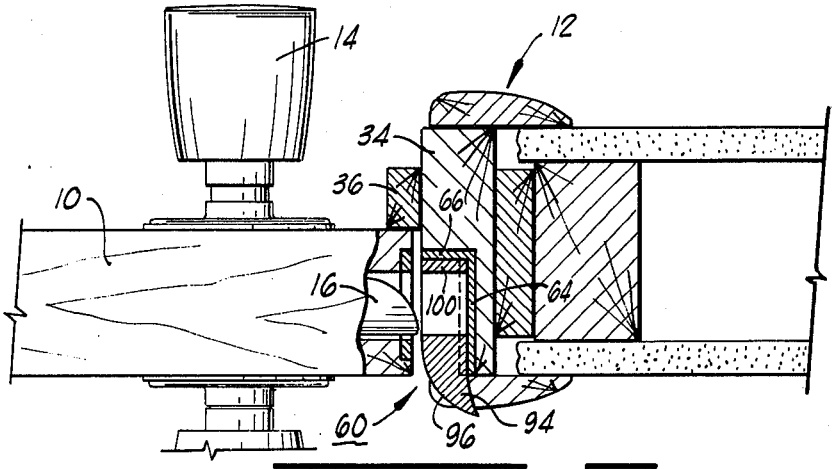
FIG. 7 is a horizontal section of an assembled and installed door lock device of the type shown in FIG. 5.
Figure 8:
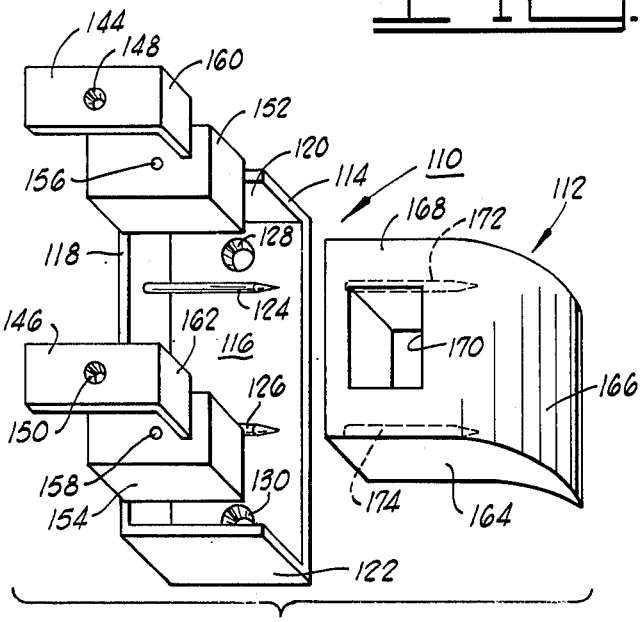
FIG. 8 is an exploded view shown in perspective of yet another alternative form of door lock device.

FIGS. 5, 6, and 7 illustrate an alternative form of door lock keeper assembly which enables the breakaway lock advantage. The keeper assembly 60 includes a right-angle jamb inset element 62 having a bottom portion 64, a rear wall portion 66 and including a pair of mounting apertures 68 for receiving screw fasteners 70 and 72 (see FIG. 6). The bottom portion 64 of the inset element 62 also includes a pair of threaded bores 74 and 76 which receive pressure applying screw fasteners 78 and 80 (FIG. 6), as secured through respective pressure plates 82 and 84 and resilient pressure pads 86 and 88, as well as flanged keeper tabs 90 and 92 of keeper element 94, as will be further described below.

The keeper element 94 may be a unitarily formed structure which includes an arcuate surface or tapered striker portion 96 extending rearward to a planar portion 98 which includes a door lock aperture 100 of generally square or rectangular configuration. Keeper tabs 90 and 92 are formed as lower edge flanges from the base of keeper element 94 to include rearwardly opening horizontal slots 102 and 104 for insertion around respective screw fasteners 78 and 80.

In operation, the keeper assembly 60 is secured within an edge cut-out portion of door jamb 34, suitable clearance being provided through external door trim, as shown in FIG. 7. The securing fasteners 70 and 72 are utilized to firmly implant the inset structure 62 within the door jamb cut-out. Thereafter, the remainder of striker assembly 60 is assembled within inset elements 62 and pressure adjusting screw fasteners 78 and 80 are aligned and threadedly tightened the desired amount to force respective pressure plates 82 and 84 and pressure pads 86 and 88 against keeper tabs 90 and 92 as seated against the opposite edges of lower portion 64 of inset elements 62. Keeper pressure is exerted not only against keeper tabs 90 and 92 but also due to lateral expansion of pressure pads 86 and 88 as forced against the respective upper and lower sides 106 of keeper element 94. If desired, upper and lower edge portions (not shown) may be formed on upper and lower ends of inset elements 62, these portions tending to confine or more advantageously direct the expansion effects of pressure pads 86 and 88.

FIGS. 8, 9, 10 and 11 illustrate a still further alternative structure which may be utilized in carrying out the essential features of the invention. A keeper assembly 110 is constructed to utilize side-applied pressure only in retaining a keeper element 112 within a door jamb inset 114. Thus, door jamb inset 114 is formed, as by bending, molding, die cast or the like, to include a bottom plate 116, rear plate 118, and upper and lower edge plates 120 and 122. A pair of guide pins 124 and 126 are fixedly secured to rear plate 118 to extend forward in parallel relationship for engagement within keeper element 112, as will be further described below.

Figure 9:
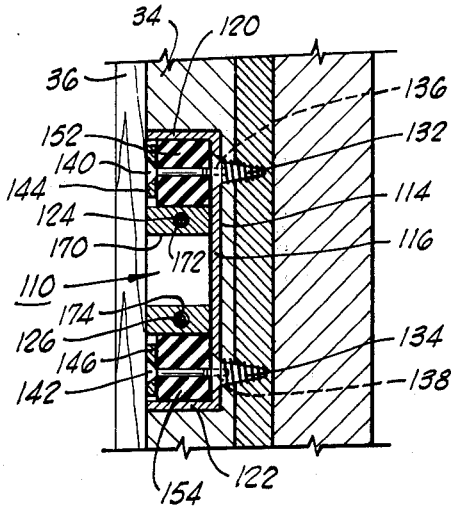
FIG. 9 is a vertical section of an assembled and installed door lock device as shown in FIG. 8.

A pair of securing bores 128 and 130 are formed through bottom plate 116 and serve to secure inset element 114 within a door jamb cut-out by means of fasteners 132 and 134 (see FIG. 9). Each of securing screws 132 and 134 include a respective axial threaded bore 136 and 138 for receiving pressure adjusting screw fasteners 140 and 142 therein.

Referring again to FIG. 8, a pair of pressure plates 144 and 146 include screw receiving apertures 148 and 150. Pressure plates 144 and 146 insert down over resilient pressure pads 152 and 154, which also include screw receiving apertures 156 and 158, and pressure plates 144 and 146 each include right angle bent forward surfaces 160 and 162, respectively, which serve to captivate pressure pads 152 and 154 and to direct primary expansion effects inward toward the sides 164 of striker element 112.

The striker element 112 is formed with an arcuate striker portion 166 and generally planar portion 168 through which is formed a generally rectangular door lock aperture 170. A pair of bores 172 and 174 are formed horizontally and parallel through the rear surface of striker element 112 on each side of lock aperture 170, the bores 172 and 174 being formed of generally similar cross-section to receive aligning pins 124 and 126 therein when keeper assembly 100 is in its assembled position.

Figure 10:
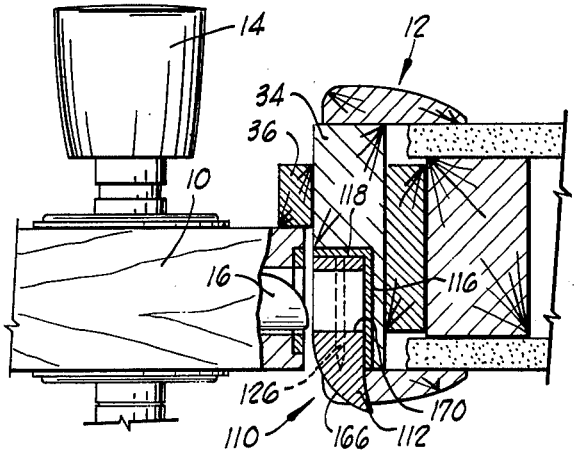
FIG. 10 is a horizontal section of an assembled and installed door lock device as shown in FIG. 8.

In operation, the keeper assembly 110 may be installed by securing inset element 114 within a door jamb cut-out as shown in FIGS. 9 and 10, with secure affixure effected by securing fasteners 132 and 134. Thereafter, respective pressure pads 152 and 154 and pressure plates 144 and 146 are loosely positioned as held by pressure adjusting screws 140 and 142, threadedly engaged along the axes of securing fasteners 132 and 134. The keeper element 112 is then inserted by engagement of pins 124 and 126 within apertures 172 and 174. Each of pressure adjusting fasteners 140 and 146 are then tightened down to a desired amount whereby pressure inwardly exerted from pressure pads 152 and 154 provides a keeping force on opposite sides 164 of keeper element 112.

Figure 11:
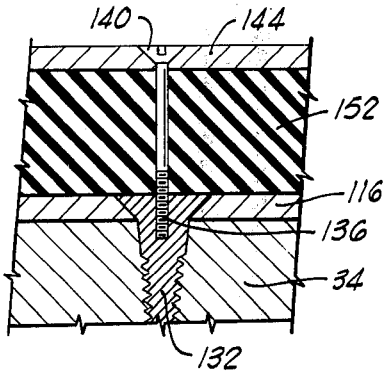
FIG. 11 is an enlarged sectional view illustrating one form of lock device securing and pressure adjusting screw combination.

FIG. 11 illustrates in enlarged view the double-screw concept wherein a pressure adjusting screw 140 secured through pressure plate 144 and pressure pad 152 may be independently adjusted to set desired keeping force. Pressure adjusting fastener 140 is secured within a threaded bore 136 axially aligned through securing fastener 132 which may be tightened independently to secure inset element bottom plate 116 to the door jamb seating 134. It should be understood, too, that the double-screw fastener may be utilized in any of the several embodiments of the invention as disclosed herein. Thus, as shown in FIG. 4, the double-screw pressure and securing fastener may easily be substituted. And, the similar screw arrangement can be utilized in structure as shown in FIG. 7 merely by aligning the securing bores into the door jamb seating surface.

The foregoing discloses novel structure relating to break-away door lock keeper assemblies, and such apparatus finds many valuable applications in intra-household usage. It is particularly useful for providing a suitable yet violable security mechanism for bathroom door locks, and can serve to avoid the many problems encountered today wherein small children sometimes get locked into the bathroom and manage to cause considerable trouble before emergency opening can be effected. It is also envisioned that the particular type of lock keeping arrangement can also be utilized for various other security applications, the keeping force being adjustable in accordance with the exigencies of the particular installation.

Changes may be made in the combination and arrangement of elements as heretofore set forth in the specification and shown in the drawings; it being understood that changes may be made in the embodiments disclosed without departing from the spirit and scope of the invention.

What is claimed is:

1. A door jamb keeper assembly for locking engagement with a door lock bolt, comprising:

an inset element for affixure within a door jamb adjacent to said door lock bolt;

a keeper element slidably retained in contact with said inset element and providing a lock aperture for receiving said door lock bolt;

pressure pad means formed from resilient material and being disposed contiguous to said inset element and in contact with said keeper element;

pressure plate means disposed contiguous to said pressure pad means; and fastener means urging said pressure plate means toward said inset element to deform said pressure pad means and place predetermined keeping pressure in said bolt receiving disposition.

2. A door jamb keeper assembly as set forth in claim 1 wherein:

said keeper element is a smooth planar plate including said lock aperture and having extending members for gripping retainder by said adjustable pressure means relative to said inset element.

3. A door jamb keeper assembly as set forth in claim 1 wherein:

said keeper element is formed to include said lock aperture and to have extending members for gripping retainder between said pressure pad means and said inset element.

4. A door jamb keeper assembly as set forth in claim 1 wherein:

said keeper element is slidably reatined adjacent to said inset element and grippingly retained through contact with said pressure pad means.

5. A door jamb keeper assembly as set forth in claim 4 which is further characterized to include:

first and second pressure plate means disposed on opposite sides of said inset element contiguous with respective first and second pressure pad means each of which exerts gripping retainder on said keeper element.

6. A door jamb keeper assembly as set forth in claim 1 wherein each of said fastener means comprises:

first fastener means securing said inset element to said door jamb, said first fastener means including an axial threaded bore therein; and second fastener means threadedly engaged in said axial threaded bore to urge said pressure plate means under pre-set force.

* * * * *